US005542576A

United States Patent [19]

Arment

[11] Patent Number: 5,542,576

[45] Date of Patent: Aug. 6, 1996

[54] APPARATUS FOR SEALING FRICTION RESEALABLE CONTAINERS DURING AIR TRANSPORT

[76] Inventor: Elton D. Arment, 3970 Brown Farm Dr., Hamilton, Ohio 45013

[21] Appl. No.: 173,270

[22] Filed: Dec. 23, 1993

Related U.S. Application Data

[63] Continuation of Ser. No. 878,547, May 5, 1992, abandoned.

[51] Int. Cl.[6] ..... B65D 45/02

[52] U.S. Cl. ..... 220/328; 220/323; 220/737

[58] Field of Search ..... 220/327, 328, 220/323, 322, 354, 742, 741, 737, 1.5, 358, 319, 23.2, 315, 325, 401, 495, 668; 206/446, 386, 1.5; 366/208, 209, 214, 605; 217/77

[56] References Cited

U.S. PATENT DOCUMENTS

| | | | |
|---|---|---|---|
| 180,661 | 8/1876 | Sidey . | |
| 233,195 | 10/1880 | Bradley . | |
| 244,245 | 7/1881 | Jackson . | |
| 380,219 | 3/1888 | Roberts | 220/323 X |
| 511,674 | 12/1893 | Bragg | 217/77 X |
| 572,818 | 12/1896 | Palmer | 220/354 |
| 927,223 | 7/1909 | Chidester . | |
| 1,277,724 | 9/1918 | Hodgson . | |
| 1,367,683 | 2/1921 | Bentley . | |
| 1,429,303 | 9/1922 | Sumbling . | |
| 1,468,375 | 9/1923 | Canby . | |
| 1,533,173 | 4/1925 | Egloff et al. | 220/327 |
| 2,317,064 | 4/1943 | Josephian | 220/23.2 X |
| 2,650,805 | 9/1953 | Schaefer | 366/214 |
| 2,885,108 | 5/1959 | Donoghue | 220/354 |
| 2,894,309 | 7/1959 | Brzowski | 366/605 X |
| 3,126,119 | 3/1964 | Callegari | 220/315 |
| 3,143,756 | 8/1964 | Sisko . | |
| 3,979,011 | 9/1976 | Schleicher | 220/741 X |
| 4,090,612 | 5/1978 | Lostutter | 366/214 X |
| 4,111,330 | 9/1978 | Jordan | 220/306 |
| 4,588,302 | 5/1986 | Pizzi et al. | 366/349 |
| 4,660,736 | 4/1987 | Mays . | |
| 4,789,245 | 12/1988 | Morbeck | 366/217 |
| 4,821,911 | 4/1989 | Lefrant . | |
| 5,174,464 | 12/1992 | Watt | 220/319 |

FOREIGN PATENT DOCUMENTS

| | | |
|---|---|---|
| 622090 | 3/1935 | Germany . |

*Primary Examiner*—Stephen J. Castellano
*Attorney, Agent, or Firm*—Wood, Herron & Evans

[57] ABSTRACT

Apparatus for preventing spillage or leakage from at least one friction resealable container, such as a paint can-type container during air transport, includes elastomeric gasket sealing the lid of the container, top and bottom braces engaging the container lid, and the bottom of the container, and a plurality of clamps connecting the two braces together. The clamps urge the braces together to compress the gasket, seal the container and hold the lid onto the container during transport.

14 Claims, 2 Drawing Sheets

FIG. IA

APPARATUS FOR SEALING FRICTION RESEALABLE CONTAINERS DURING AIR TRANSPORT

This application is a continuation of application Ser. No.878,547, filed May 5,1992 now abandoned.

FIELD OF INVENTION

This invention relates to an apparatus for sealing a friction resealable container, such as a paint can-type container, to prevent leakage or spillage of volatile materials during air transport.

BACKGROUND OF THE INVENTION

As the air transport industry has developed, so have regulations on what goods are transportable by air and how those goods are to be packaged for air shipment. One concern of the air transport industry, as well as the various governmental entities worldwide which control this industry, is the air shipment of potentially harmful or destructive materials, for example, corrosive, poisonous, flammable, toxic and volatile materials.

The International Air Transport Association (i.e., IATA) has specified a number of standards for the shipment of such materials. The standards specified by this organization have been generally adopted by the United Nations and are enforced by many governments worldwide. The U.S. has adopted standards which are similar, if not identical, to the IATA standards. One of the goals of the IATA standards is to prevent the leakage of such potentially harmful or destructive materials from their shipping containers into the environment of the transporting aircraft. With this goal in mind, the 1992 IATA standards Paragraph 5.0.2.9 requires that these materials be shipped in containers capable of withstanding an internal pressure of about 14 psi without the container leaking its contents, whether liquid or in vapor form. Presently, the U.S. only requires enforcement of this container leaking standard on international shipments and not domestically. However, it is predicted that the U.S. will require this standard for domestic shipments in the near future.

Such potentially harmful or destructive materials are often shipped in regular paint can-type containers, with press fit or friction resealable lids. While these containers are adequate to store such materials when shipped by land, they have been found generally inadequate for shipment by air. These materials are generally volatile in nature, and produce their own vapor pressure when stored in such containers. These containers are usually filled at around sea level under about one atmosphere of pressure (i.e., around 14 psi). When the containers are in the air during transport, the pressure outside the container drops because of the altitude while the pressure inside remains relatively unchanged. This pressure differential, along with the vapor pressure due to the volatile nature of these materials, can cause vapors to leak out of the container. Depending on the nature of the material being stored, these vapors can have a variety of detrimental effects on the aircraft structure itself, other goods being shipped and personnel on the aircraft, as well as those who unload the aircraft.

While containers themselves can be specially designed for shipping these potentially harmful or destructive materials by air, such special containers are often more expensive than standard paint can-type containers. In addition, many manufacturers of these materials ship their product by land, as well as by air. Thus, it is desirable for these manufacturers to have one standard container for their product which can be used regardless of whether shipment is by land or air. Standard paint can-type containers are relatively inexpensive. Therefore, there is a need for an apparatus which would prevent materials from leaking out of such standard paint can-type containers during shipment by air, and which is relatively inexpensive compared to using containers which have been especially designed for air transport.

SUMMARY OF THE INVENTION

This invention is directed to an apparatus for preventing the contents of a friction resealable container, such as a paint can-type container, from leaking out of the container during air transport. The present invention is cost effective in shipping potentially harmful or destructive materials by air in standard paint can-type containers and still meets the 1992 IATA standards Paragraph 5.0.2.9 and its U.S. equivalent.

Accordingly, a preferred embodiment of the invention maintains at least one container with potentially harmful or destructive contents in a sealed condition during air transport of the container. The container has a top, a bottom, an opening in the top bordered by a first ceiling convolution and a resealable container lid, for covering the opening in the container. The lid has a matching second sealing convolution dimensioned to frictionally seal with the first sealing convolution. The apparatus comprises an elastomeric gasket for positioning between the first ceiling convolution and the second ceiling convolution. A top brace engages the container lid, a bottom brace engages with the bottom of the container, and a plurality of clamps connect the two braces together. Each of the clamps has a first end connected to the top brace and a second end connected to the bottom brace. The container is locatable between at least two of the clamps. The clamps are adjustable for forcing the braces close enough together to compress and thereby seal the gasket between the first and second ceiling convolutions to the point that vapors from the contents remain sealed in the container during air transport.

Accordingly, the container is braced by the top and bottom braces and compression. The above and other objectives, features and advantages of the present invention will become apparent upon consideration of the detailed description and appended drawings.

BRIEF DESCRIPTION OF THE DRAWINGS

FIG. 1A is an enlarged view of the circled area 1A of FIG. 1.

DETAILED DESCRIPTION OF THE INVENTION

Figure 1:
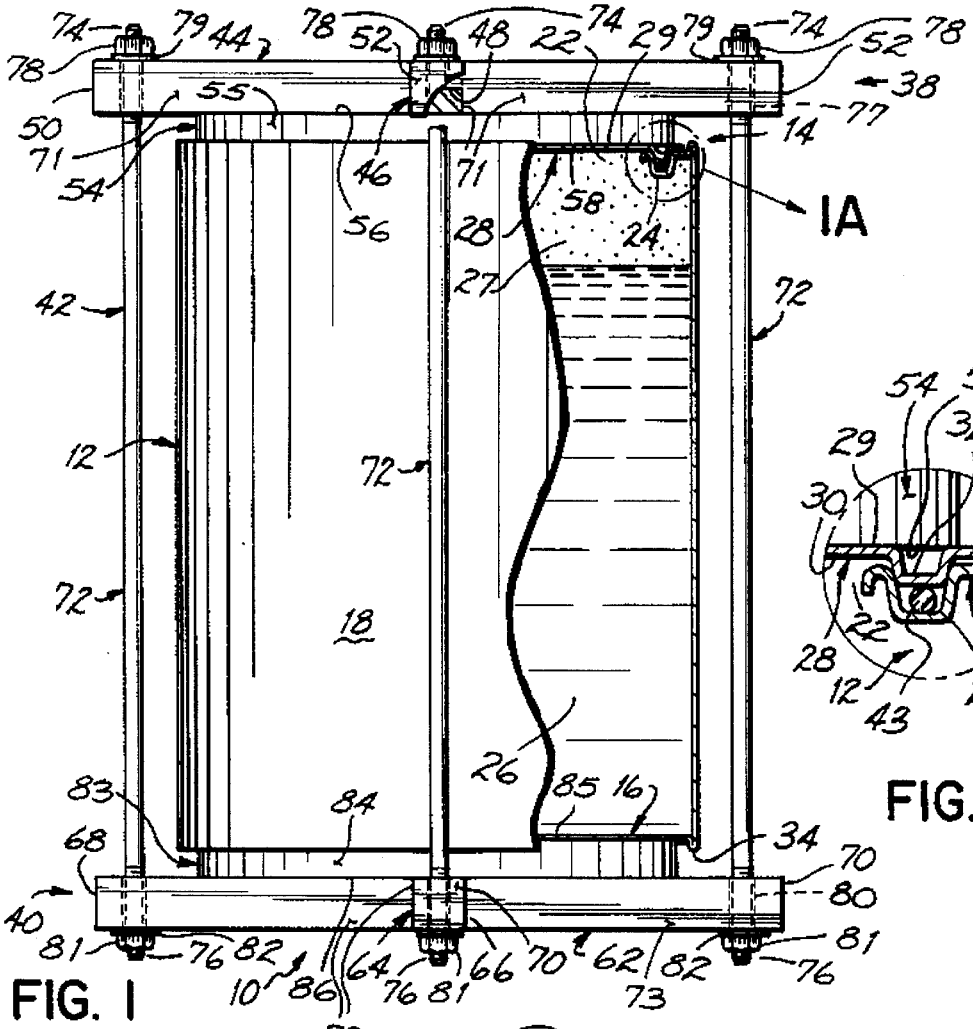
FIG. 1 is a side view, partially broken away, of an apparatus according to the present invention with a friction resealable container located therein.
Figure 2:
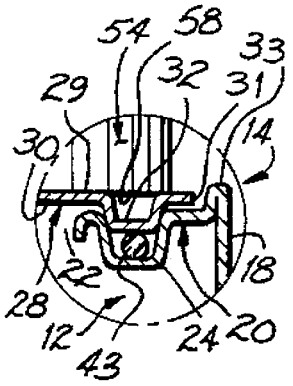
FIG. 2 is a top view of the apparatus and container of FIG. 1.
Figure 2:
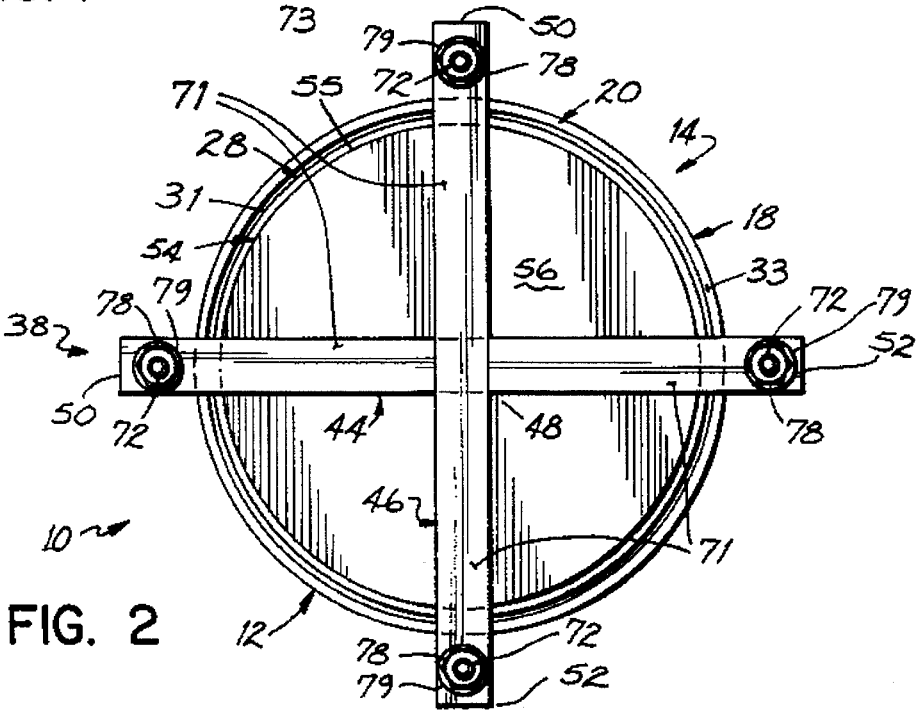

Referring to FIGS. 1, 1A and 2, an apparatus 10 according to the present invention is used to maintain a friction resealable container, such as a one gallon paint can-type container 12 having potentially harmful or destructive contents, in a sealed condition during shipment of the container 12 by air transport. One possible container 12 is cylindrical in shape with a top 14, a bottom 16 and a cylindrical side wall 18. The top 14 has a circular rim 20 defining a circular opening 22. The rim 20 has a first sealing convolution or annular groove 24 formed therein. The container 12 is filled through the opening 22 with contents 26 which produce a vapor 27. The opening 22 is covered with a press fit or friction resealable lid 28 having a top surface 29, a bottom surface 30, an outer circumferential edge 31 and a second sealing convolution or annular rib 32. The annular groove 24 is dimensioned to frictionally receive and form a press fit seal against the annular rib 32. The cylindrical side wall 18 has a circular top edge 33 which extends above the rim 20 and a circular bottom edge 34 which extends below the bottom 16.

In one embodiment of the present invention, the apparatus 10 has a top brace member 38 disposed above a bottom brace member 40 with the container 12 positioned therebetween. A plurality of clamps 42 connect the two braces 38 and 40 and are adjustable to force the two braces 38 and 40 together. An O-ring gasket 43 is disposed between the annular groove 24 and the annular rib 32 before the container 12 is positioned between the braces 38 and 40, and the clamps 42 are adjusted to force the braces together.

Preferably, the top brace 38 is adapted to engage only the container lid 28. The top brace 38 comprises a first top crossbar 44 traversing a second top crossbar 46. The crossbars 44 and 46 are joined together at a cross-lap joint 48 generally halfway along their respective lengths. The crossbars 44 and 46 are oriented generally perpendicular to each other and lie generally co-planer. Each of the crossbars 44 and 46 has a first end 50 and a second end 52. The top brace 38 further comprises a circular compression block 54 disposed between the crossbars 44 and 46 and the container lid 28. The block 54 has a circumferential side 55. An upper surface 56 of the block 54 is in contact with the crossbars 44 and 46 and is preferably centered under the joint 48. A bottom surface 58 of the block 54 is in contact with the container lid 28. Preferably, the compression block 54 has a diameter at least about as large as the diameter of the lid 28, yet small enough so that the side 55 of the block 54 will fit within the circular top edge 33 of the container 12 with the block 54 contacting only the lid 28.

The bottom brace 40 comprises a first bottom crossbar 62 and a second bottom crossbar 64 which are joined together by a cross-lap joint 66 in the same manner as the crossbars 44 and 46 of the top brace 38, described above. Each of the crossbars 62 and 64 have a first end 68 and a second end 70. Preferably, all the crossbars 44, 46, 62 and 64 are about the same length. Each top crossbar 44 and 46 is separated into two segments 71 and each bottom crossbar 62 and 64 is separated into two segments 73, each of preferably equal length, by its respective cross-lap joint 48 and 66. In addition, the first top crossbar 44 is located directly above the first bottom crossbar 62 and the second top crossbar 46 is located directly above the second bottom crossbar 64. The first end 50 and second end 52 of the top crossbars 44 and 46 are likewise located directly above the first end 68 and second end 70 of their respective bottom crossbars 62 and 64.

Each of the clamps 42 comprises a rod 72 having a threaded top end 74 and a threaded bottom end 76. Each of the rods 72 is attached at its top end 74 and its bottom end 76 to the top brace 38 and the bottom brace 40, respectively. Each of the rods 72 is disposed through a clamping hole 77 formed through the ends 50 and 52 of each of the crossbars 44 and 46. The threaded top end 74 of each of the rods 72 extends out of one of the holes 77 and above the top brace 38. A hex nut 78 is threadably disposed on each of the threaded top ends 74. Preferably, a washer 79 is also disposed on each of the threaded top ends 74, between each nut 78 and the top brace 38. Each of the rods 72 is also disposed through a clamping hole 80 formed through the ends 68 and 70 of each of the bottom crossbars 62 and 64. The threaded bottom end 76 of each of the rods 72 extends out of one of the holes 80 and below the bottom brace 40. A hex nut 81 is threadably disposed on each of the threaded bottom ends 76. Again, a washer 82 is preferably disposed on each of the threaded bottom ends 76, between each nut 81 and the bottom brace 40. The clamping holes 77 and 80 are each spaced about the same distance from their respective cross-lap joints 48 and 66, in order to keep the rods 72 vertically oriented.

A circular spacer pad 83 is positioned between the bottom 16 of the container 12 and the bottom brace 40. The spacer pad 83 is adapted to prevent the container 12 from contacting the bottom brace 40 when the braces 38 and 40 are forced together by the clamps 42, and to prevent the bottom 16 from bulging during air transport from pressures inside the container 12. The spacer pad has a circumferential side 84. An upper surface 85 of the pad 83 is in contact with and preferably centered under the bottom 16 of the container 12. A bottom surface 86 of the pad 83 is in contact with the crossbars 62 and 64 and is preferably centered above the joint 66. Preferably, the spacer pad 83 has a diameter slightly less than the diameter of the bottom 16 so that the side 84 of the pad 83 will fit within the circular bottom edge 34 of the container 12 with the pad 83 contacting only the bottom 16.

The container 12 is prepared for air shipment by first removing the lid 28 and positioning the O-ring gasket 43 into the annular groove 24 and then replacing the lid 28. The O-ring gasket 43 should have a thickness which allows a partial friction seal to be formed between the rib 32 and the groove 24. This partial friction seal helps to prevent inadvertent spilling or seepage of the contents 26 during the initial preparation stages. With the O-ring gasket 43 in place, the container 12 is then positioned between the two braces 38 and 40 as previously described and shown in FIG. 2. With the container 12 so positioned, each of the nuts 78 threaded on the top end 74 of each of the rods 72 is tightened in order to force the top brace 38 and bottom brace 40 together. Forcing the braces 38 and 40 together compresses the O-ring gasket 43 between the rib 32 and the groove 24, sealing the contents 26, including the vapor 27, in the container 12. The O-ring gasket 43 flattens as this compressive force pushes the rib 32 deeper and deeper into the groove 24. To obtain the strongest seal, the nuts 78 should be tightened until the O-ring gasket 43 is fully compressed (i.e., the rib 32 no longer sinks into the groove 24). Further tightening beyond this point risks crushing or otherwise damaging the container 12. Both the compression block 54 and spacer pad 83 should be thick enough to keep the top edge 33 and bottom edge 34 of the container 12 from contacting the top crossbars 44 and 46 and the bottom crossbars 62 and 64, respectively, when the gasket 43 is in a fully compressed state. To avoid confusion, the block 54 and pad 83 can be made identical and thus interchangeable.

When used with a standard one-gallon (U.S. or Imperial) paint can-type container 12, an O-ring gasket 43 having an inside diameter of about 5.75" and a thickness of about 0.103" has been found to provide an effective seal (i.e. to withstand an internal pressure of at least 14 psi), while still allowing an initial partial friction seal to be formed between the rib 32 and groove 24.

Figure 3:
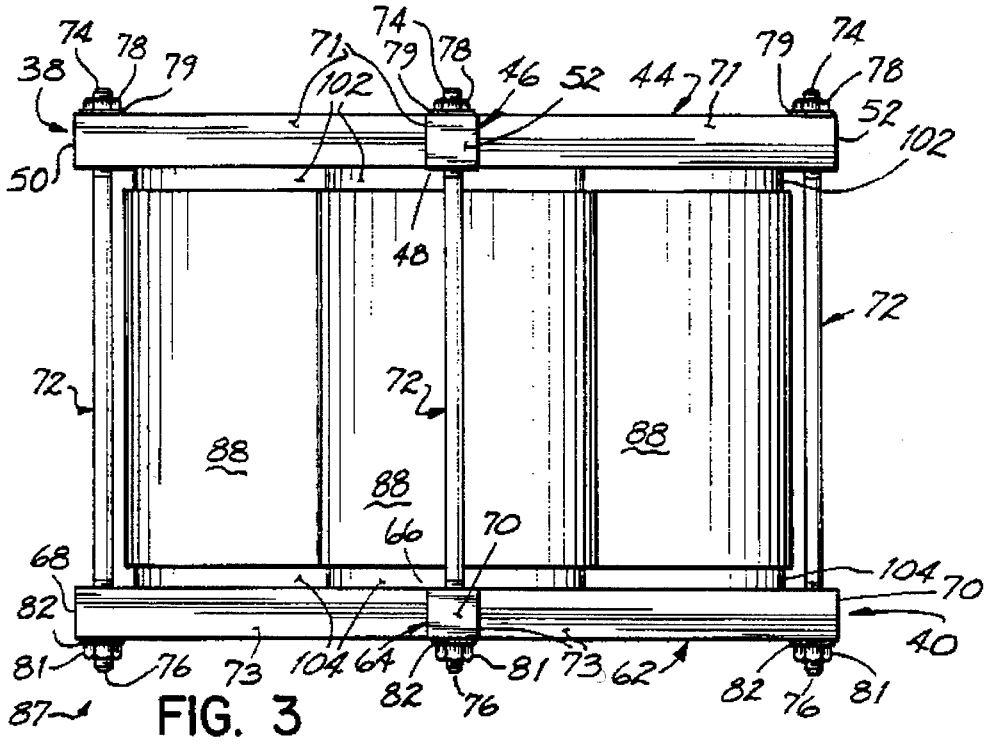
FIG. 3 is a side view of an alternative embodiment of the present apparatus with four friction resealable containers located therein.
Figure 4:
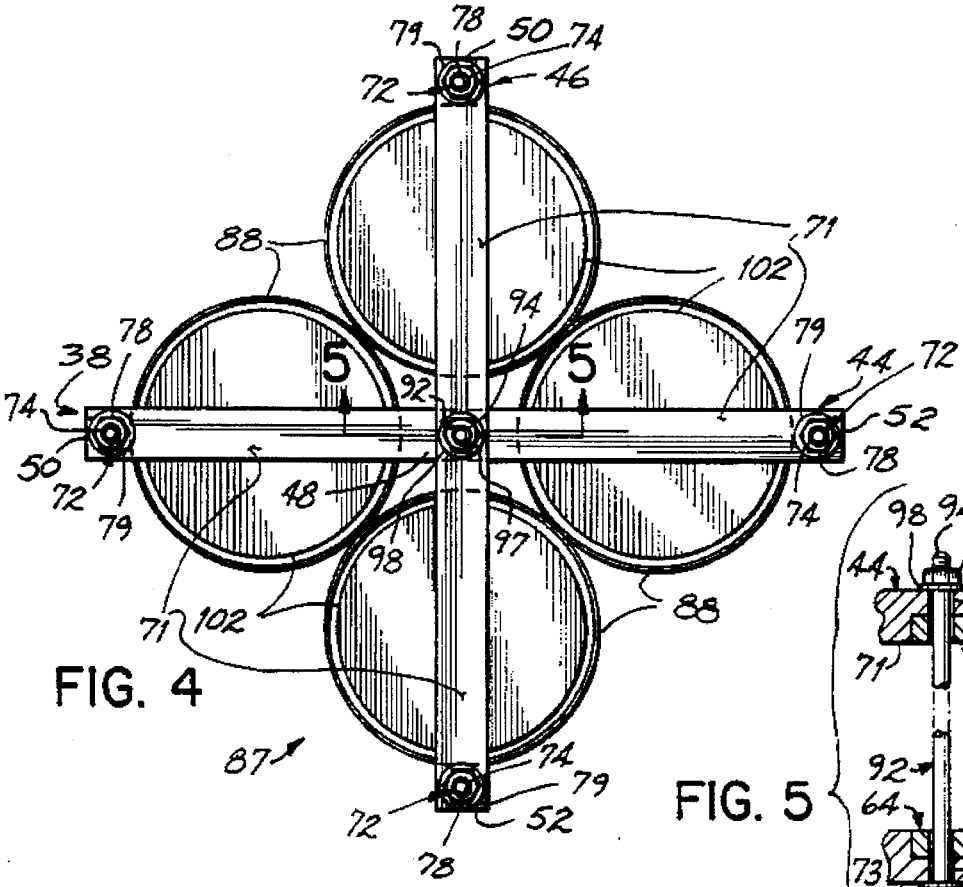
FIG. 4 is a top view of the alternative embodiment and containers of FIG. 3.
Figure 5:
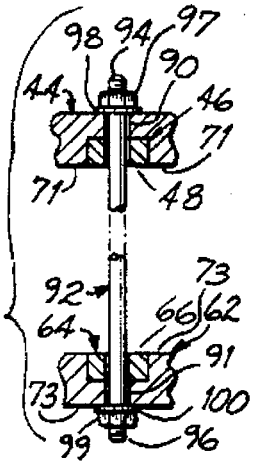
FIG. 5 is a fragmentary sectional view taken along lines 5—5 of FIG. 4.

Referring to FIGS. 3 and 4, another embodiment of an apparatus 87 according to the present invention is used for shipping smaller than gallon-size containers 12, for example, one-quart size containers 88. The apparatus 87 is basically the same as apparatus 10 except with slight modifications which allow apparatus 87 to maintain the seal of four containers 88, as opposed to the one container 12. The apparatus 87 has additional clamping holes 90 and 91 formed through the cross-lap joints 48 and 66, respectively. An additional rod 92 having a threaded top end 94 and a threaded bottom end 96 is disposed through the two holes 90 and 91 in the same manner as previously described for the rods 72. A hex nut 97 and washer 98 and another hex nut 99 and washer 100 are disposed on the threaded top end 94 and bottom end 96, respectively, of the rod 92 in the same manner as previously described for the rods 72.

The four containers 88 are positioned between the crossbars 44 and 46 of the top brace 38 and the crossbars 62 and 64 of the bottom brace 40. A compression block 102 and spacer pad 104 are otherwise centered above and below each container 88, respectively, and also dimensioned in the same relative manner as the block 54 and pad 83 for the previous embodiment. One of the crossbar segments 71 extends across and above each of the compression blocks 102. One of the crossbar segments 73 extends across and below each of the spacer pads 104. Each of the containers 88 is disposed between the rod 92 and one of the rods 72. Each container 88 likewise has an O-ring gasket (not shown), disposed as previously described.

Sealing all four containers 88 with the apparatus 87 is accomplished in a procedure similar to that previously described for sealing container 12 with the apparatus 10, except that the nut 97 on the top end 94 of the rod 92 is also tightened. When used with a standard one-quart paint can-type container 88, an O-ring gasket (not shown) having an inside diameter of about 3.125 inches and a thickness of about 0.103 inches has been found to provide an effective seal (i.e., to withstand an internal pressure of at least 14 psi), while still allowing an initial partial friction seal to be formed. Regardless of which apparatus is used, 10 or 87, each nut should be tightened so that the top brace 38 and bottom brace 40 exert an even compression on the O-ring in each container 12 and 88.

From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

What is claimed is:

1. A kit including components for maintaining at least one sealed container in a sealed condition during air transport, the at least one container being of the type having a top, a bottom, an opening in the top bordered by a first sealing convolution and a resealable container lid for covering the opening in the at least one container, the container lid having a second sealing convolution for frictionally cooperating with the first sealing convolution to seal the at least one container, elastomeric gasket being disposed and compressed between the first sealing convolution in the at least one container and the second sealing convolution in the container lid, said kit comprising the combination of:

an elastomeric o-ring gasket for disposition and compression between the first sealing convolution in the at least one container and the second sealing convolution in the container lid;

a top brace member;

a compression block for disposition between said top brace member and the container lid when said apparatus is applied to a container, and engaging only the container lid when said at least one container is in the sealed condition;

a bottom brace member; and at least one clamp operably connected to said top and bottom brace members for clamping and moving said brace members toward each other when the at least one container is disposed therebetween, for forcing the compression block and any container lid thereunder toward the at least one container to compress the gasket between the first and second sealing convolutions and thereby sealing said at least one container, and for holding said at least one container in the sealed condition during air transport thereof.

2. The kit of claim 1, wherein the top of the at least one container is of the type having a perimeter formed by a top edge and wherein said compression block has a perimeter dimensioned to fit within the perimeter formed by the top edge of the at least one container.

3. The kit of claim 2, wherein the top perimeter of said container is circular and wherein the perimeter of said compression block is circular in shape.

4. Apparatus for shipping volatile or liquid substances by air transport comprising:

at least one container having a top and a bottom, opposite sides, an opening in said top bordered by a continuous groove and a resealable container lid for covering said opening, said container lid having a sealing rib therearound for frictionally sealing with said groove to seal said at least one container;

an elastomeric ring gasket disposed between said groove and said rib;

a top brace member disposed across and above the top of said at least one container and having opposite ends extending radially outward beyond said at least one container, said top brace member including a compression disposed for engaging said lid and for pushing said lid into sealing engagement about said opening without obstruction by said container;

a bottom brace member disposed below and across the bottom of said at least one container and having opposite ends extending radially outward beyond said at least one container; and a plurality of clamps, each of said clamps operably connected between said top brace member and said bottom brace member, with at least one of said clamps being disposed adjacent a side of said at least one container opposite another clamp, said clamps being adjustable for urging said brace members toward each other to force said compression block and said container lid toward said at least one container and to compress said ring gasket between said groove and said rib to seal said at least one container against leakage therefrom of volatile or liquid substances therein during air transport thereof.

5. The apparatus of claim 4, said container lid having an outer periphery and the bottom surface of said compression block being disposed within said outer periphery when said at least one container is sealed.

6. The apparatus of claim 5, said compression block being disposed within the outer periphery of said container lid when said at least one container is sealed.

7. The apparatus of claim 4 including a spacer pad disposed between said bottom brace member and the bottom of said at least one container when said at least one container is sealed, said bottom brace member being held away from said container bottom by said spacer pad.

8. The apparatus of claim 7, the bottom of said at least one container having an outer periphery and said spacer pad having an upper surface disposed within the outer periphery of said at least one container when said at least one container is sealed.

9. Apparatus for maintaining the integrity of a plurality of containers containing volatile or liquid substances during air transport, each of the plurality of containers having a top defined in part by a convolution for frictionally and releasably receiving a cooperating convolution defined in a container lid, and a plurality of elastomeric gaskets, each elastomeric gasket being disposed respectively between the container and the lid convolutions of one of the plurality of containers, the apparatus comprising:

a top brace member;

a plurality of compression blocks, each of which is for disposition between said top brace member and one of the container lids when said apparatus is applied to a container and each block engaging only one container lid, when said plurality of containers are in a sealed condition;

a bottom brace member; and a plurality of clamps operably connected between said top and bottom brace members for clamping and moving said brace members toward each other when applied to a plurality of containers therebetween, for forcing each of the container lids toward one of the plurality of containers to compress each gasket between corresponding convolutions and thereby sealing each of the plurality of containers, and for maintaining the plurality of containers in the sealed condition during air transport thereof.

10. The apparatus as in claim 9, said top and bottom brace members each having opposite ends extending outwardly beyond the plurality of containers and said clamp means being disposed for operatively urging together respective opposite ends of said top brace member with respective opposite ends of said bottom brace member.

11. The apparatus as in claim 10, said top and bottom brace members each having a center portion located between said opposite ends, said center portions being aligned with each other and including a clamp operably connected between center portions of said top and bottom brace members for operatively urging said center portions together.

12. The apparatus as in claim 9 including a spacer pad disposed between each of the containers and said bottom brace member when said apparatus is applied to a plurality of containers and when the containers are sealed, said bottom brace member being held away from the containers by said spacer pads.

13. The apparatus of claim 9, the tops of each of said plurality of containers are of the type having a perimeter formed by a top edge and wherein each respective compression block of said apparatus has a perimeter disposed within the perimeter formed by the corresponding top edge.

14. The apparatus of claim 13, the perimeter of the top of each of said plurality of containers is circular and wherein the perimeter of each corresponding compression blocks is circular in shape.

* * * * *